United States Patent [19]

Hutchinson

[11] 4,314,632

[45] Feb. 9, 1982

[54] INSERT FOR TILLS

[76] Inventor: Richard T. Hutchinson, 109 Public Sq., Gallatin, Tenn. 37066

[21] Appl. No.: 72,262

[22] Filed: Sep. 4, 1979

[51] Int. Cl.[3] ..... A45C 11/28

[52] U.S. Cl. ..... 206/0.81; 232/43.1

[58] Field of Search ..... 232/43.1, 43.2, 66; 312/204; 206/0.81, 559, 560, 565

[56] References Cited

U.S. PATENT DOCUMENTS

| | | | |
|---|---|---|---|
| 919,083 | 4/1909 | Spenner | 232/66 |
| 1,349,527 | 8/1920 | Owen | 206/0.81 |
| 1,754,911 | 4/1930 | Sherwood et al. | 312/204 X |
| 2,594,653 | 4/1952 | Jertson | 206/0.81 |
| 2,849,177 | 8/1958 | Meyer | 232/43.1 |

FOREIGN PATENT DOCUMENTS

| | | | |
|---|---|---|---|
| 322114 | 6/1920 | Fed. Rep. of Germany | 206/0.81 |

*Primary Examiner*—Francis K. Zugel

*Attorney, Agent, or Firm*—John B. Hardaway, III; Wellington M. Manning, Jr.; Luke J. Wilburn, Jr.

[57] ABSTRACT

A till insert for quickly and reliably receiving selected coins or currency to be deposited therein, said device being a five-sided, longitudinal container with the side nearest the cashier being upturned in an arcuate fashion and having positioned in its face a frontal opening for receiving therein said currency, and with the side opposite the cashier being open for purposes of discharging the container's contents. Said insert being designed for mating snugly within a bill compartment of a till without defeating entirely its use for receiving therein other forms of currency.

4 Claims, 3 Drawing Figures

INSERT FOR TILLS

BACKGROUND OF INVENTION

1. Field of Invention

This invention relates to cash drawers or tills and more specifically to inserts for the same which are intended to safely and securely separate coins, currency, or other memoranda of sales transactions and transfers of cash.

2. State of Prior Art

The only known prior art in this field is a pivoted baffel which was used in some cash drawers or tills to store larger denomination bills on the underside of the baffel while smaller denominations were placed on top of the baffel by the receiving clerk or cashier. The standard cash register bail was utilized in this arrangement to hold down the separate denomination bills and baffel. To place large denomination bills in this arrangement, the cashier lifted both the bail and the pivoted baffel in one simultaneous movement. For smaller denomination bills, the cashier would simply lift the bail and place the bill on top of the baffel or bills thereon resting. The present invention bears no functional or structural similarities to this prior art.

By way of explanation, the standard cash drawer is universally manufactured with five coin trays for pennies, nickels, dimes, quarters, and half dollars and with four currency trays for one, five, ten, and twenty dollar bills. While various companies may vary somewhat from this format, it is generally true that conventional drawers or tills present these slots for receipts and distribution of cash in most merchantile establishments. When a cashier receives a personal check, a cashiers check, a large denomination bill, such as a fifty or one hundred dollar bill, they must raise the coin tray and place it below the opened drawer or till since a conventional slot does not exist for this item. Additionally, some merchantile establishments, such as laundries and car washes, received transaction memorandums which must also be disposed of in the above described manner. This nonconventional process is undesirable and is expensive because of expended employee time in performing this task. From an effective management of time standpoint, it is wholly unsatisfactory. Yet, such inefficiency has been present in our merchantile system for many years simply because no device has been advanced which could achieve these significant cost reductions in labor and improve employee morale at the same time by abolition of menial tasks and unnecessary steps in the performance of their duties. Further, the significant time savings which could be made by such a device would mean shorter lines and quicker service resulting in greater customer satisfaction.

Recently, the machine vendors' lobby has brought a great deal of pressure upon the United States Congress to enact legislation which would simplify their business operations by the minting of one dollar coins to be used in vending machines. The rapid advance of inflation has severly affected sales from such machines because of the sheer magnitude and weight of coins one must insert in the machine to comprise today's sale price. Virtually no one carries that many coins in their pocket comfortably. The existing silver or Eisenhower dollar coin was unsatisfactory from the machine vendors' standpoint because of the substantial modifications which would be necessary for a vending machine to handle it. Also, the existing coin was unsatisfactory from the consumer standpoint because of the sheer bulk and weight of the coin. For these reasons, the Susan B. Anthony dollar coin was introduced in the United States on July 2, 1979. This new dollar coin is smaller and lighter than its predecessor and resembles the existing quarter in size.

Rather than resolving this problem, however, the new coin has only further complicated matters. The foregoing features of the Susan B. Anthony dollar may only lead to its ultimate demise because of the danger of commingling the dollar coins with the quarter coins. This simple mistake could lead to errors by clerks or cashiers in receiving and dispensing cash. It may also lead to customer complaints regarding overpayment for goods or services. To avoide such erroneous receipts, merchants will most likely take the course of action that they have applied in the past and take the coin out of circulation by placing it within a separate compartment within or below the till. See, *The Wall Street Journal*, July 19, 1979, at page 1, Column 6, Volume LXIV, No. 13. The coin thus taken from circulation would be returned to the bank by the merchant with his day's receipts. On the other hand, consumers would probably take similar action to remove the coin from circulation by hoarding or simply placing it aside from their normal change. These were the courses of action taken by merchants and consumers with the Eisenhower dollar, the fifty cent piece, and the two dollar bill. The Treasury Department concedes that these forms of currency are virtually white elephants and practically ceased minting them.

Susan B. Anthony dollars may go the same way unless immediate action is taken to improve their general acceptance. From the consumer standpoint, proper precaution and education should lead to their more widespread acceptance. Certainly, vending machine purchases are a way of life today and the coin is needed if vending machine operators will convert their machines to receive and handle this coin. Further, the nonacceptance of the Susan B. Anthony dollar, in addition to lost minting costs, could absolutely frustrate the overall plan of the Treasury Department to modify our existing currency by replacing the one dollar bill as our basic bill with the two dollar bill, by abolishing the fifty cent piece entirely, and replacing the dollar bill and the Eisenhower dollar coin with the Susan B. Anothony dollar coin. If this plan is put into effect, the standard cash drawer or till would hold pennies, nickels, dimes, quarters, and Susan B. Anthony dollars in the five coin trays and two, five, ten, and twenty dollar bills in its currency trays. This system, however, does not provide for a transition phase in the currency change over or propose any ways to offset labor costs, customer complaints, or erroneous balances which may occur during this period.

Assuming that merchants, consumers, and machine vendors want to cooperate with the Treasury Department and accomplish this currency change over, a method must be derived whereby merchants can receive and continue circulation of coins and currency or other memoranda of transactions with the assurance that errors will not occur. Certainly, one way of accomplishing this task would be for the cash register manufacturers to produce new cash drawers or tills with more compartments. This solution, however, is unacceptable for seveal reasons. First, the sheer number of cash drawers and tills utilized by merchants and others is of such an order of magnitude that the new drawers could not be produced, installed, and placed into operation in a timely fashion. Second, the economy as a whole would suffer dire consequences if owners of cash drawers and tills were required to expend money without government subsidy to accomodate the currency changeover. And thirdly, the manufacture of cash drawers or tills with additional compartments for coins or currency would most certainly mean reduced space of trays for existing currencies. Additionally, clerks or cashiers wold have to learn a different lay out for coins and currency within the new tray. This alone could necessitate substantial loss of manpower and errors in receiving and disbursing cash. Therefore, a more economic and satisfactory transition period for currency change over would be to propose a device which would fit into existing cash drawers or tills without significant size modifications or changes in layout. The present invention accomplishes this very purpose.

SUMMARY OF INVENTION

Therefore, it is a principal object of the present invention to provide a cash drawer or till insert which is simple in design and operation, easily constructed and inexpensively manufactured, and suitable for the intended purposes of improving circulation of certain coins or currency. It is another object of the invention to create a device that is compact and durable and which operates in a quick, reliable fashion to improve clerk or cashier efficiency and accuracy. It is a further object of the invention to propose a device which achieves significant reductions in labor costs and improves services rendered to customers by shortening lines and accelerating transaction times. It is an additional object of the invention to provide a device having a dependable service life, unless abused or neglected, which is versatile and unique to the merchantile trade. It is a final object of the invention to provide a device which is easily fabricated, inexpensively manufactured and readily mass produced in adequate quantities to make it a commercial and economic success.

These and other objects of the invention are satisfied by the present invention which obviates the problems mentioned above and which accomplishes the objectives and purposes herein specified.

This is accomplished by the present device which is basically an elongated, rectangular box designed to be inserted into a bill tray opening of a cash drawer or till with a snug fit. One end of the box, the one most adjacent to the clerk is formed in an arch to accomodate the curved surface of most cash drawers or tills. In those having rectangular compartments, the present invention can still fit properly within the tray be tangently resting upon the perpendicular surfaces. It is held in position by the top surface of the box resting upon the rear side of the tray, furthest from the clerk. This surface will always fit in such a manner by provision of an unduly long top surface which must be trimmed to accomodate the various manufacturer's till opening. No special tools or personnel are envisioned as necessary to perform this adjustment. As a reasonable alternative to this elongated surface, an adjustable, spring actuated stop could be placed on the rear of the till insert.

The present invention is constructed of a lightweight, durable material which can be selected from various materials of construction. It has sufficient thickness to adequately receive and store coins or currency in the desired manner, and yet, still provide storage space along its top surface for larger denomination bills such as twenties. The standard tray bail will also rest upon the insert and the currency thereon positioned. Based upon the individual establishment's type of business, inserts of various thicknesses or slot openings can be manufactured and offered for sale to accomplish the desired purposes.

BRIEF DESCRIPTION OF THE DRAWINGS

These and other aspects of the invention will be more fully understood and appreciated from the following detailed description and explanation of the accompanying drawings in which.

DETAILED DESCRIPTION

Figure 1:
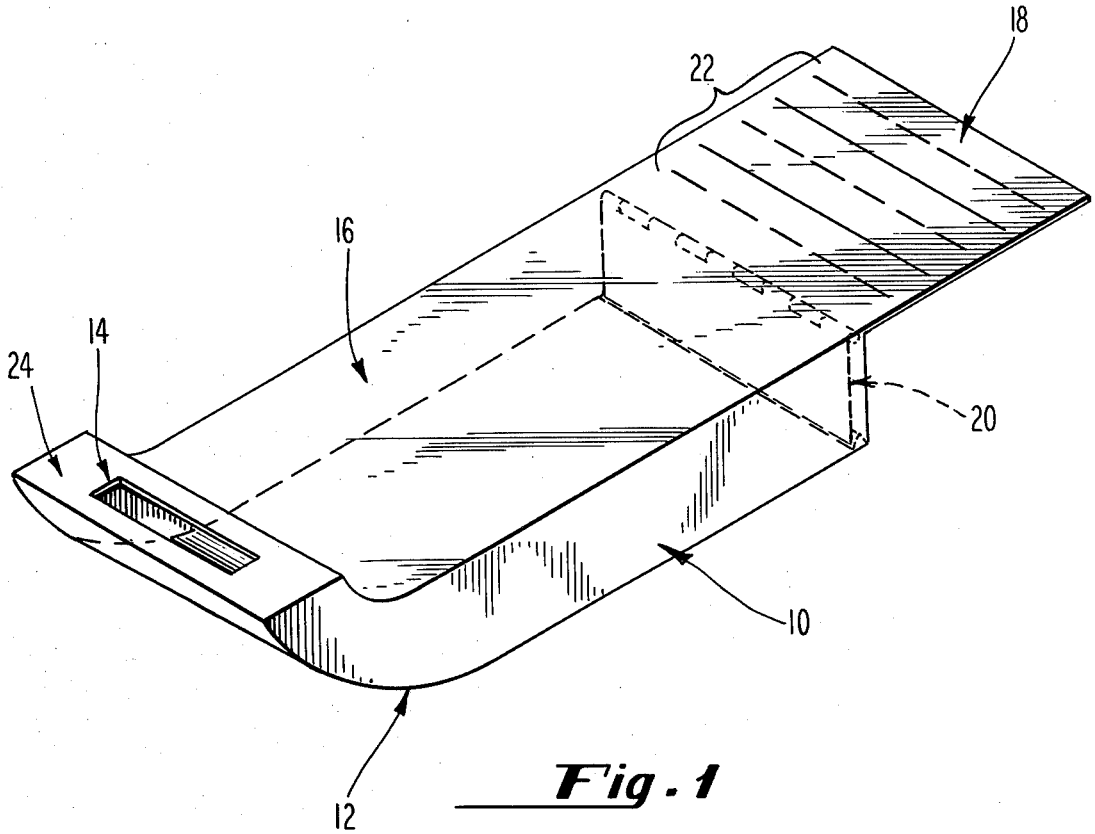
FIG. 1 is a perspective view of the till insert comprising the present invention.

Throughout the description that follows, like numerals refer to similar parts or features in the various drawings.

The reference numeral 10 generally identifies the till insert in the description that follows. In its preferred embodiment, it is essentially an elongated, rectangular box designed with a slight upturn or arch 12 on one end. For purposes of description and proper orientation, this upturned end will hereinafter be identified as the clerk side of the insert. This concave surface is designed along such an arch as to accomodate all curved surfaces to till trays utilized by the various manufacturers. The elongated top surface 16 is designed with a trim tab 18 which can be adjusted to allow a tight fit of the insert within the till tray compartment. This is accomplished by providing this extension with a series of parallel grooves or perforations 22, dependent upon the material of construction, which can be severed or broken off by conventional means. An equivalent of this elongated surface 18, but a more expensive alternate, is to manufacture the till insert 10 with a spring-loaded stop between the rear wall of the present invention and the rear wall of the tray compartment in whih it is installed.

The flat surface 24 extends above the top surface 16 to the point practically level with the top of the till compartment. As thus designed, the present invention is unique, novel, and versatile. It can be utilized by practically any clerk or cashier without any additional training or period of learning adjustment. Further, no special skills or tools are required to install, operate, or remove the present invention. This simplicity assures widespread acceptance by both employees and merchants. Said success will assure continued receipt and circulation of coins and currency distributed by the Department of the Treasury in its effort to change over our present currency habits as above described.

FIG. 1 is a perspective view of the till insert which depicts these elements in detail. In order to provide the design features above mentioned, the present device 10 should be manufactured from a durable, lightweight material of construction. Plastic inserts, formed by conventional extrusion molding processes would be one acceptable material satisfying this specification. An additional benefit which could be derived from a plastic insert would be universatility from one molding size. The coin slot 14 could be expanded to accomodate various size coins or currency by the merchant after he purchased only one model at his office supply store.

Further, the trim tab 18 could more readily be severed by the purchaser if it were constructed of plastic. An alternate material of construction would be metal of suitable alloy construction or aluminum; so long as it is lightweight. This model would lack some versatility since it would have to be manufactured and purchased in various coin or currency slot 14 sizes. However, the trim tab 18 would remain adjustable by the merchant with conventional tools and without special mechanical skills or abilities. Either plastic or metal should have satisfactory strength and durability to withstand the common everyday wear and tear of the merchantile trade to which cash registers and components are subjected. Thus, a device fabricated from such materials will have a lengthy and dependable service life throughout the anticipated transition period while our currency system changes over as above described. Till inserts manufactured from either plastic or metal can be easily fabricated, inexpensively manufactured, and readily mass produced and distributed in sufficient quantities to make it a huge economic and commercial success. Conventional manufacturing processes without highly skilled labor or specialized machines can be used to manufacture the present invention of these materials of construction assuming a low sales price and preventing the previosly mentioned diversion of economic resources for a new, additionally compartmented cash drawer. The present invention further assures that the cash drawer or till would lose only minimal space in one tray compartment as compared to a new, multi-compartmented drawer with more than five coin and four currency slots. Because of less space in such a newly designed drawer, the register would have to be read and the drawer changed out more frequently since it would fill faster assuming the same number of daily receipts.

Figure 2:
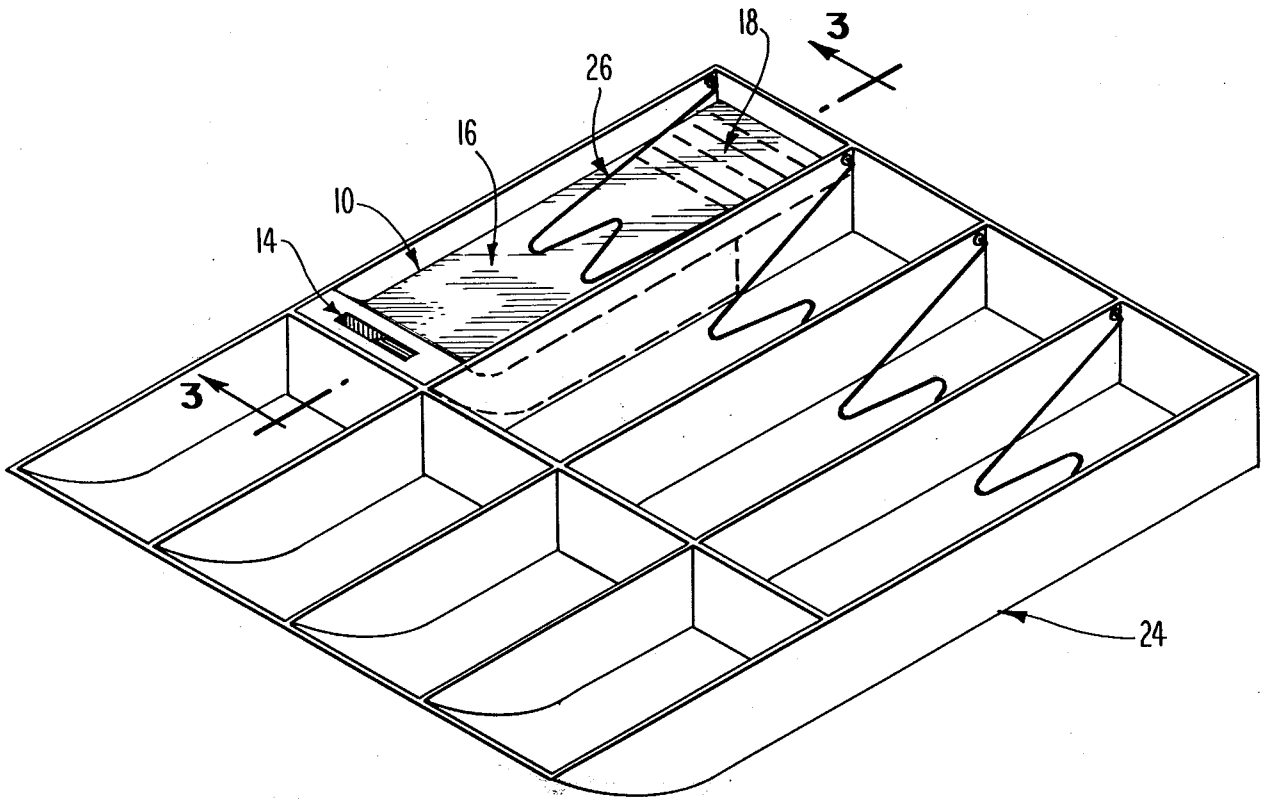
FIG. 2 is a perspective view of the invention as installed in a till.

FIG. 2 is a perspective view showing the present invention 10 positioned within a standard cash drawer 24. The invention is held in place by the joint interaction of its own weight, surface contacts with the till compartment, and the standard cash drawer bail 26. As shown, the trimmable tab 18 on surface 16 has been adjusted to give a snug fit at the rear wall of the compartment 30. This adjustment is a simple mechanical step and can be accomplished by virtually anyone with standard tools. If the material of construction is plastic, the series of grooves 22 which can be molded into the plastic during the injection process can be cut to the necessary length by a pair of scissors or pocket knife. Alternatively, if the material of construction is metal, the series of preforations 22 which can be made during the forming process can be severed by cutting means, such as a saw, or by breaking means, such as two pairs of pliers properly positioned and the application of a twisting motion to the section to be discarded.

Figure 3:
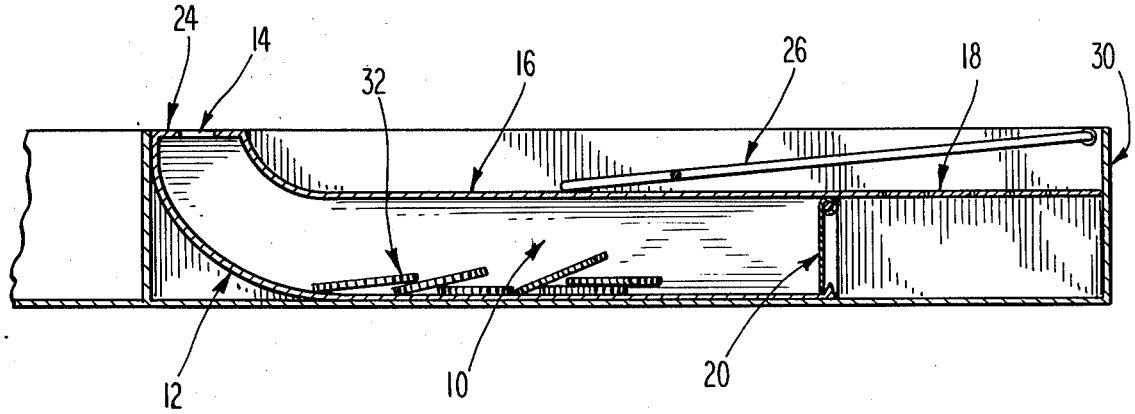
FIG. 3 is a side view in cross-section of the insert resting within the tray compartment.

FIG. 3 is a cross-sectional view of the till insert 10 resting within a plane elevational view of the tray compartment of FIG. 2. For the purposes of this description, the tray compartment is cross-sectioned. In use, the cashier or clerk would simply drop an item such as a coin through the coin slot 14 which slides down the arch 12 and rests at a point 32 within the till insert 10 where it meets resistance. The present invention 10 is held in place by the interaction of its own weight, deposited coins, currency or other items, its geometry which is in contact with the surfaces of the tray compartment, and the standard cash register bail 26. In particular, the till insert should custom fit within the tray compartment along is longitudinal axis. This is accomplished by severing the trim tab 18 at a position very close to the rear wall 30 of the compartment. Although the present invention does take up some of the space within the tray compartment, bills can still be stored within the compartment by placing them between the top surface 16 and the bail 26. Preferably, the till insert 10 would be placed in the twenty dollar, or largest denomination bill compartment. This is because fewer of these denomination bills are received and less space is needed compared to the smaller denomination bills. An optional hinge or spring-loaded flap 20 could be installed within the till insert 10 in the bottom or rear side. Such a device would allow easy removal of the present invention from the till compartment without any spillage or loss of contents into the cash drawer. However, such a flap is unnecessary to the practice of the invention if the proper care is taken in removing the till insert from the tray compartment. When the present invention is used in the manner described above, the possibilities of commingling of cash or coins and erroneous disbursements are obviated because of the currency which is most likely to cause such an error is safely stored within the present device. As is readily apparent, the clerk or cashier has expended only minimal time in making such a drop thereby improving the efficiency of his work and decreasing customer service time. Such advantages to the merchantile trade are highly desirable. For instance, fewer clerks could be used to reliably wait upon the same number of customers without any fear or erroneous receipts or disbursals of currency. The former practice of clerks and cashiers to lift the cash tray up to dispose of such items is thus eliminated by the present invention. By eliminating the menial and tedious task of placing coins, currency, or other transaction memoranda into the cash drawer after lifting out the till, clerks or cashiers will have a more positive attitude, better disposition, and improved work performance. Also, the physical stress or exhaustion formerly incurred in the performance of these useless steps is obviated.

The innovative device disclosed herein has proven to be extremely versatile, reliable, and efficient in practice while safely and securely separating or isolating coins and currency. It may be mass produced in sufficient quantities to assure low and reasonable production costs for the manufacturer which can be passed along to the retail outlet, such as an office supply or hardware store. Its simplicity in design, uncomplicated structure, and practicality assure widespread use and acceptance by the merchantile establishment.

From the foregoing description and reference to the accompanying drawings, it is believed that a clear precise, and comprehensive understanding of the construction, operation, utilization, and the advantages of the present invention may be had by one normally skilled in the pertinent art of till manufacture.

While the present invention has been illustrated and described herein with respect to a certain specific embodiment, it will be appreciated by those skilled in the art that many adaptations, modifications or departures can be made within the spirit and scope of the present invention. Accordingly, it is intended by the appended claims to cover all such adaptations, modifications, or departures as are the equivalents of the herein illustrated and described till insert.

What is claimed and desired to be secured by Letters Patent from the United States of America is:

1. An elongated till insert for quickly and reliably receiving selected currency deposited therein by a cashier, said insert securely and safely mating within a bill section of a cash register tray without defeating entirely the use of said section for the receipt of other currency, said insert comprising:

a first panel having a concave end portion and defining a top for said insert;

a second panel shorter than said first panel, and acting as a bottom of said till, said second panel having a similar concave geometry on one end to said first panel and being positioned under said first panel to lie in a parallel relationship thereto;

a third panel being shorter than all other panels and defining within its confines a frontal opening constituting a means for receiving, said third panel being positioned between said first and second panels at the concave extremities thereof;

fourth and fifth panels forming sides between said first and second panels, said sides adjoining said third panel and thus defining a receiving compartment having an opening at the end opposite said third panel;

positioning means located at the extremity of said first panel opposite said end having a concave configuration; and a flap closure connected to said first panel so as to define a closure for said opening at the end opposite said third panel while being capable of flapping open only into said compartment for the purpose of removing the contents of said compartment;

said compartment adapted for the receipt of coins through said means for receiving and discharge of coins through said flap closure, said concave surface when mated to a bill section defining an open volume for the storage of bills.

2. An elongated till insert for quickly and reliably receiving selected currency deposited therein by a cashier, said insert securely and safely mating within a bill section of a cash register tray without defeating entirely the use of said section for the receipt of other currency, said insert comprising:

a first panel having a concave end portion and defining a top for said insert;

a second panel shorter than said first panel, and acting as a bottom of said till, said second panel having a similar concave geometry on one end to said first panel and being positioned under said first panel to lie in a parallel relationship thereto;

a third panel being shorter than all other panels and defining within its confines a frontal opening constituting a means for receiving, said third panel being positioned between said first and second panels at the concave extremities thereof;

fourth and fifth panels forming sides between said first and second panels, said sides adjoining said third panel and thus defining a receiving compartment having an opening at the end opposite said third panel;

positioning means located at the extremity of said first panel opposite said end having a concave configuration, said positioning means comprising severable perforations for permitting removal adjustment of the length of said first panel, so as to permit mating of said insert with various sizes of bill sections; and a flap closure connected to said first panel so as to define a closure for said opening at the end opposite said third panel while being capable of flapping open for the purpose of removing the contents of said compartment;

said compartment adapted for the receipt of coins through said means for receiving and discharge of coins through said flap closure, said concave surface when mated to a bill section defining an open volume for the storage bills.

3. An elongated till insert for quickly and reliably receiving selected currency deposited therein by a cashier, said insert securely and safely mating within a bill section of a cash register tray without defeating entirely the use of said section for the receipt of other currency, said insert comprising:

a first panel having a concave end portion and defining a top for said insert;

a second panel shorter than said first panel, and acting as a bottom of said till, said second panel having a similar concave geometry on one end to said first panel and being positioned under said first panel to lie in a parallel relationship thereto;

a third panel being shorter than all other panels and defining within its confines a frontal opening constituting a means for receiving, said third panel being positioned between said first and second panels at the concave extremities thereof;

fourth and fifth panels forming sides between said first and second panels, said sides adjoining said third panel and thus defining a receiving compartment having an opening at the end opposite said third panel;

positioning means located at the extremity of said first panel opposite said end having a concave configuration;

a flap closure connected to said first panel so as to define a closure for said opening at the end opposite said third panel while being capable of flapping open for the purpose of removing the contents of said compartment; and means to permit opening of said flap closure only into said compartment;

said compartment adapted for the receipt of coins through said means for receiving and discharge of coins through said flap closure, said concave surface when mated to a bill section defining an open volume for the storage of bills.

4. The till insert of claim 3 wherein said means to permit is attached to said second panel to restrict the size of said opening at the end opposite said third panel.

* * * * *